United States Patent [19]

Hergeth

[11] Patent Number: 4,969,236

[45] Date of Patent: Nov. 13, 1990

[54] SHAFT MIXER

[76] Inventor: Hubert Hergeth, Kockerellstrasse 3, 5100 Aachen, Fed. Rep. of Germany

[21] Appl. No.: 178,557

[22] Filed: Apr. 7, 1988

[30] Foreign Application Priority Data

Apr. 23, 1987 [DE] Fed. Rep. of Germany ..... 3713590

[51] Int. Cl.[5] ..... D01G 13/00

[52] U.S. Cl. ..... 19/145.5

[58] Field of Search ..... 19/145, 145.5

[56] References Cited

U.S. PATENT DOCUMENTS

| | | | |
|---|---|---|---|
| 1,319,486 | 10/1919 | Pirtle | 19/145.5 |
| 3,648,330 | 3/1972 | Binder et al. | 19/145.5 |
| 4,531,262 | 7/1985 | Reiche | 19/145.5 |

FOREIGN PATENT DOCUMENTS

| | | | |
|---|---|---|---|
| 34104 | 8/1908 | Austria | 19/145.5 |
| 1160425 | 7/1986 | Japan | 19/145.5 |
| 267393 | 7/1970 | U.S.S.R. | 19/145.5 |
| 806790 | 2/1981 | U.S.S.R. | 19/145.5 |
| 1298269 | 3/1987 | U.S.S.R. | 19/145.5 |

*Primary Examiner*—Werner H. Schroeder
*Assistant Examiner*—D. Price
*Attorney, Agent, or Firm*—Herbert Dubno

[57] ABSTRACT

A shaft mixer is disclosed having a number of shaft to which fibers are simulatneously supplied and drawn off again from the individual shafts at differing speeds. The drawn-off fibers are supplied collectively to a connected machine.

1 Claim, 1 Drawing Sheet

SHAFT MIXER

Figure 1:
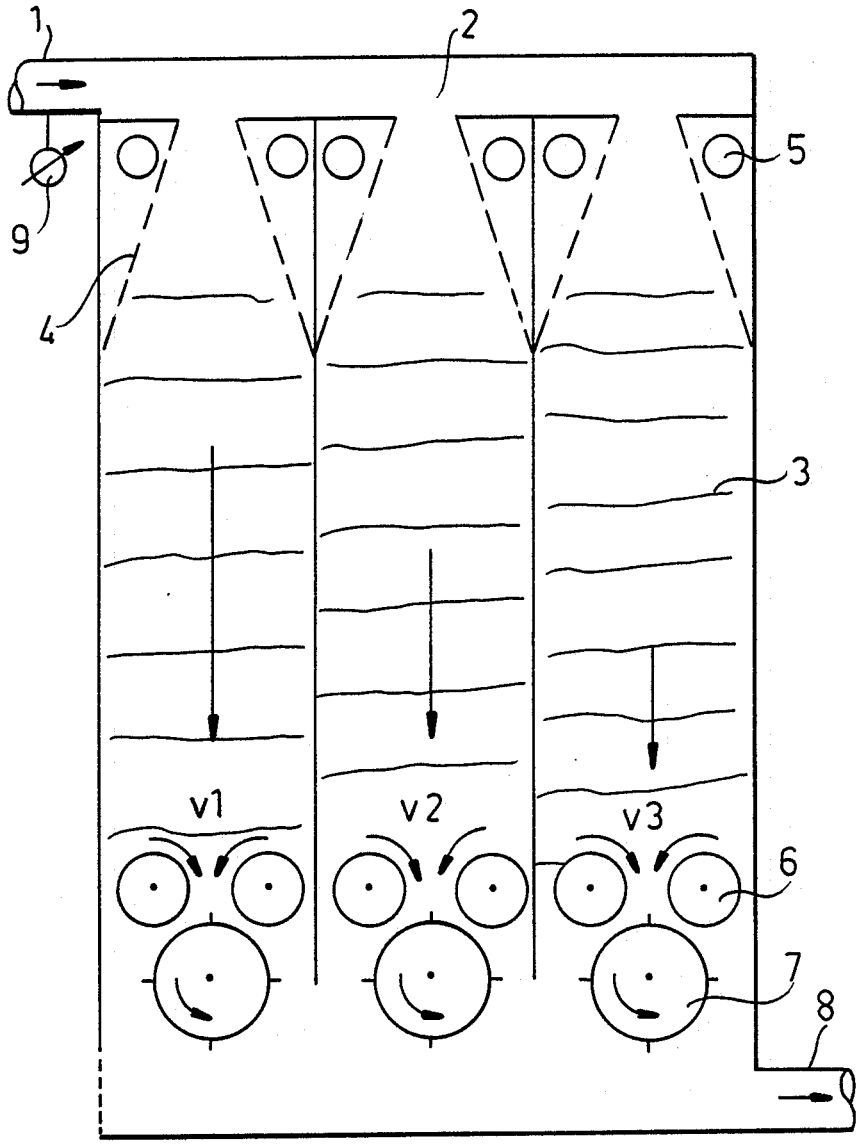

A number of machines and methods are known for the mixing of textile fiber tufts. (Cf. W. Oeser: "Mechanische Spinnerei" (=Mechanical Spinning), 1971, pages 17–24 and 117–126). Mixing takes place either in succession, layers being built up successively and demolished jointly, or as in a hopper feeder, in which a large mass of fibers is continuously circulated and small quantities removed and supplied. In shaft mixers, which have been popular since the beginning of the 1960s, shafts are successively filled with fibers. The shafts are emptied simultaneously by drawing-off rollers operating at the same speed, and the fibers removed from the shafts are brought together on a conveyer belt or in a collecting channel. Successive filling as a rule produces different heights of the material in the shafts. The first shaft is supplied again only when it is almost empty and the last shaft is filled. As a rule therefore, the mixer is at most two-thirds filled with fibers. If all the chambers were to be almost completely filled and were to be continued to be filled in quick succession, the result would be a horizontal layer of identical fibers, which would then be removed simultaneously by the drawing-off rollers, so that no mixing would take place. German Patent Specification No. 3 151 063 discloses a possible way of improving mixing using conventional shaft mixers. One disadvantage of conventional shaft mixers is that the shafts are not completely filled, thus shortening the bridging time if the preceding machines fail. The flaps provided on conventional shaft mixers for closing the individual shafts repeatedly cause fiber accumulations and therefore malfunctions, resulting in troublesome interruptions of production.

It is an object of the invention to provide a shaft mixer which operates without unreliable distributing flaps, can be 100% filled and is of very simple construction. This is done according to the invention by the use of a new mixing process. In the process all the shafts are simultaneously connected to the supply of mixed fibers and air and can be simultaneously filled with fibers. The air escapes through sieve surfaces in the upper parts of the shafts. The fibers are drawn from the shafts to a differential extent, so that the fiber layers are offset and thus fibers supplied to the mixer at different times leave the shaft mixer simultaneously after passing the drawing-off device. The shaft mixer comprises at least 2 shafts. As a rule the mixer will have 3, 6 or 9 shafts. The simplest way of ensuring that the fiber layers are offset is to drawn the fibers from the individual shafts at different speeds. For example, the fibers might be drawn from shaft 1 at a speed of 1.0 m per minute, from shaft 2 at a speed of 0.15 m per minute and from shaft 3 at a speed of 0.2 m per minute. As a rule the drawing-off rollers are driven by a common toothed-belt which acts on driving wheels of different diameters for each of the shafts. The loosening rollers can all rotate at the same speed.

Another, but more complicated construction would be for the drawing-off devices to run for different times. For example, if the following machine required material, or over a predetermined interval of time, shaft 1 would draw off fibers for one second, shaft 2 for two seconds and shaft 3 for three seconds. After being removed from the shafts, the fibers are loosened by a loosening roller and supplied via a common conveying system to the next machine.

FIG. 1 is a diagrammatic cross-section through the shaft mixer. Fiber tufts and air enter the mixer via a supply line 1. The fibers fly through supply line 2 which is shared by all the shafts and become deposited in the shafts 3. The air escapes through sieve surfaces 4 and passes via tubes 5 to the air-conditioning installation. Pairs of drawing-off rollers 6 draw the fibers from the shafts as required by a connected machine. The drawn-off fiber mats are loosened by loosening rollers 7 into tufts and removed from the outlet 8 of the mixer by an air flow. A press switch 9 switches off the supply of fibers when the mixer is filled to a predetermined extent. The offsetting of the supplied fiber layers is effected by different speeds v1, v2, v3 of the drawing-off rollers.

I claim:

1. A method of homogenizing a mixture of textile fibers which comprises the steps of:

(a) simultaneously supplying a fiber mixture to a plurality of upright filling shafts;

(b) drawing fibers from the bottoms of said shafts by rotating respective discharge rollers at the bottom of each of said shafts;

(c) maintaining different speeds of removal of the fibers from each of said shafts by providing said rollers having different diameters from shaft to shaft and rotating said rollers with the same drive;

(d) maintaining a speed difference in the removal speeds of at least 10% for the removal of the fibers from said shafts; and (e) depositing the fibers removed from each of said shafts in a respective layer to form a plurality of superimposed layers and jointly feeding said layers in a common conveying system.

* * * * *